US005988423A

United States Patent [19]

Auzureau

[11] Patent Number: 5,988,423

[45] Date of Patent: Nov. 23, 1999

[54] CONTAINER COVER WITH RADIALLY EXPANSIBLE SEAL AND COMPRESSING ROD

[75] Inventor: Joël Auzureau, Asnieres, France

[73] Assignee: le Joint Francais SNC, Paris, France

[21] Appl. No.: 08/589,680

[22] Filed: Jan. 22, 1996

[30] Foreign Application Priority Data

Jan. 23, 1995 [FR] France ..... 95 00713

[51] Int. Cl.[6] ..... B65D 53/00

[52] U.S. Cl. ..... 220/233; 220/260; 220/315; 220/378; 277/206 R

[58] Field of Search ..... 277/206 R, 102, 277/1, 9, 78, 121, 123, 125, 213, 188 A, 130–132, DIG. 3; 220/215, 233, 234, 337, 260, 315, 318, 319, 320, 796, 799, 800, 801–804, 806, 378, 780, 784, 789, 790, 792, 794, 284, 262, 264, 323, 367.1

[56] References Cited

U.S. PATENT DOCUMENTS

| | | | |
|---|---|---|---|
| 65,476 | 6/1867 | Devoe | 220/806 |
| 323,153 | 7/1885 | Ives | 220/804 |
| 360,663 | 4/1887 | Daniels | 220/315 X |
| 1,747,591 | 2/1930 | Moore | 220/804 |
| 2,674,390 | 4/1954 | Meyer | 220/804 |
| 3,013,823 | 12/1961 | Schulz | 277/125 X |
| 3,064,853 | 11/1962 | Lents et al. | 220/804 |
| 3,227,462 | 1/1966 | Tamplen | 277/102 |
| 3,294,274 | 12/1966 | Spitzberg | 220/803 |
| 3,419,280 | 12/1968 | Wheeler | 277/125 X |
| 3,767,215 | 10/1973 | Brown | 277/125 |
| 3,784,214 | 1/1974 | Tamplen | 277/213 X |
| 3,915,462 | 10/1975 | Bruns et al. | 277/123 X |
| 4,209,105 | 6/1980 | Dominique | 277/206 R X |
| 4,261,584 | 4/1981 | Browne et al. | 277/206 R |
| 4,408,771 | 10/1983 | Shelton | 277/206 R |
| 4,434,910 | 3/1984 | Groult | 220/804 |

FOREIGN PATENT DOCUMENTS

| | | | |
|---|---|---|---|
| 1145850 | 10/1957 | France | 277/206 R |
| 539026 | 8/1941 | United Kingdom | 220/323 |

*Primary Examiner*—Stephen K. Cronin
*Attorney, Agent, or Firm*—Morgan, Lewis & Bockius LLP

[57] ABSTRACT

A cover for a container includes a peripheral seal disposed in a peripheral chamber of the cover and radially expansible into sealing engagement with a wall of the container in response to axial or radial compression of the seal by a flexible rod inserted into the peripheral chamber and against the seal.

19 Claims, 5 Drawing Sheets

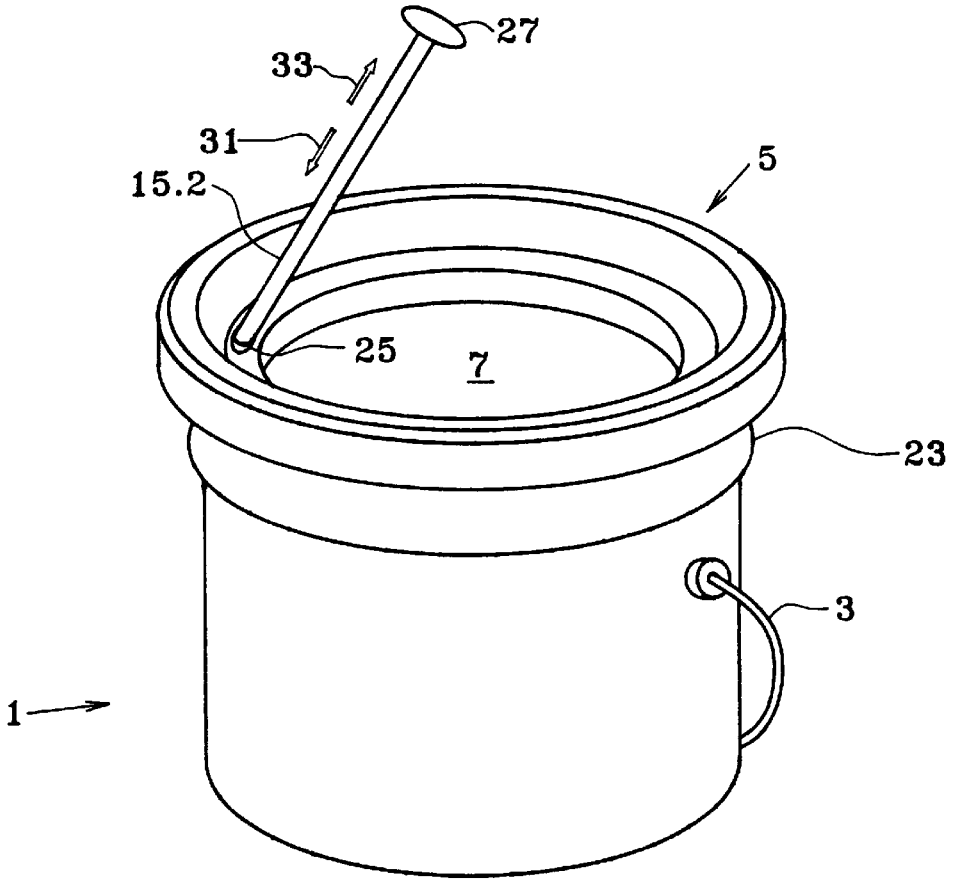
FIG. 1
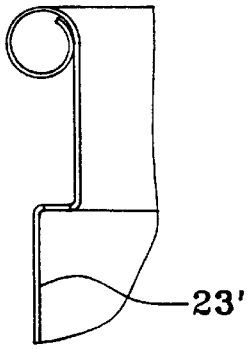
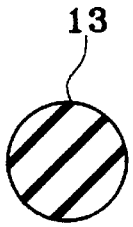
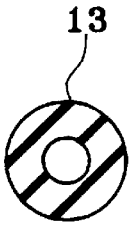
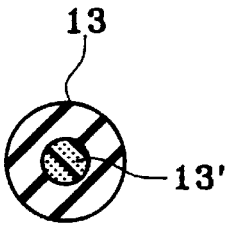
FIG. 6 FIG. 7 FIG. 8 FIG. 9

CONTAINER COVER WITH RADIALLY EXPANSIBLE SEAL AND COMPRESSING ROD

BACKGROUND OF THE INVENTION

The present invention principally relates to a cover, particularly for a hermetically sealed reservoir, to the reservoir, particularly to the can comprising such a cover, and to a process for hermetically sealing such a reservoir.

None of the reservoir closure devices, particularly of paint cans, of a known type, really provides full satisfaction. They are difficult to open, and the closure of a partially used can does not guarantee the tightness of the seal.

SUMMARY OF THE INVENTION

It is in consequence one aim of the present invention to offer a cover for a reservoir, particularly for a paint can, permitting easy opening without a tool.

It is a further aim of the present invention to offer such a cover permitting the easy, tool-free closure of a reservoir which has been opened by the end user.

It is a further aim of the present invention to offer such a cover presenting a low production cost.

It is a further aim of the present invention to offer such a cover of which the assembly can easily be automated.

These aims are achieved in the invention by a cover provided with a peripheral seal whose axial compression and/or radial thrust causes radial expansion of the seal, ensuring the mechanical blocking of the cover on the reservoir, as well as a hermetic seal. Due to the elasticity of the seal, the removal of the compression means permits the opening of the reservoir. Upon the replacement of the cover in position, the reservoir can be re-closed by a renewed compression of the seal.

The invention principally relates to a cover for hermetically sealing an opening, comprising a wall extending substantially over the whole surface of the opening to be closed and a seal extending on the periphery of said wall, comprising a peripheral chamber for receiving the seal integral with said wall and comprising a peripheral opening extending along the perimeter of the chamber, as well as compressing means of the seal substantially over its whole length, and furthermore comprising reversible mechanical control means of the peripheral or radial compression and expansion of the seal substantially over its whole length, so that it presses against a receiving surface delimiting the opening to be closed.

The invention also relates to a cover for hermetically sealing an opening, comprising a wall extending substantially over the whole surface of the opening to be closed, and a seal extending on the periphery of said wall, which comprises a peripheral chamber for receiving the seal integral with said wall and comprising a peripheral opening extending over the perimeter of the chamber, as well as compressing means of the seal along the normal to the wall substantially along its whole length. The seal is compressible in such a way that a compression along the normal to the wall and/or to the opening to be closed causes it to expand peripherally or radially substantially in the plane of the wall or of the opening to be closed. And furthermore, it comprises reversible mechanical control means for compressing the seal substantially along its whole length.

The invention also relates to a cover, wherein the compressing means of the seal comprises a flexible rod, and wherein the cover comprises an opening for the longitudinal introduction of the rod into the chamber.

The invention also relates to a cover, wherein the compressing means of the seal also comprises a washer disposed in the chamber between the seal and the rod.

The invention also relates to a cover, wherein the peripheral chamber has a substantially rectangular cross-section.

The invention also relates to a cover, wherein the wall and the peripheral chamber are obtained by the deformation of a single piece of sheet metal.

The invention also relates to a cover, wherein the seal has a C-shaped form, with the convexity pointed towards the opening of the chamber.

The invention also relates to a cover, wherein the rod has a circular cross-section and a length substantially equal to the length of the seal, and is made of a material having good axial rigidity while being flexible perpendicularly to its axis, particularly made of plastic.

The invention also relates to a reservoir, particularly a can, having a wall delimiting an opening to be closed, said wall having a concavity on the periphery of the opening to be closed, which comprises a cover, and wherein the concavity forms a bearing surface for the seal of the cover in a closed condition.

The invention also relates to a reservoir, wherein the concavity is a groove forming the edge of the opening to be closed.

The invention also relates to a reservoir, wherein said reservoir is a can of paint of substantially cylindrical shape.

The invention also relates to a process for closing a reservoir with a cover of the invention, which comprises a step consisting in disposing the cover on the opening to be closed, and a step consisting of the insertion of the rod into the peripheral chamber of the cover.

The above and other objects and advantages of the invention will be apparent from the following description taken in conjunction with the accompanying drawings wherein:

FIG. 1 is a perspective view of an embodiment of the can of the invention;

FIG. 2*a* is a cross-section of a first embodiment of a can of the invention in an open condition;

FIG. 2*b* is an analogous view of the can of FIG. 2*a* in a closed condition;

FIG. 3*a* is a cross-section of a detail of the preferred embodiment of a can provided with a cover of the invention in an open condition;

FIG. 3*b* is an analogous view of FIG. 3*a* in a closed condition;

FIG. 4*a* is a cross-section of a detail of a first embodiment of a can provided with a cover of the invention in the open condition;

FIG. 4*b* is an analogous view of the can of FIG. 4*a* in a closed condition;

FIG. 5*a* is a cross-section of a detail of a second embodiment of a can provided with the cover of the invention in an open condition;

FIG. 5*b* is an analogous view of the can of FIG. 5*a* in a closed condition;

FIG. 6 is a cross-section of a detail of an embodiment of a can capable of receiving a cover of the invention;

FIGS. 7 to 9 are cross-sections of three embodiments of seals capable of being used in the device of the present invention.

In FIGS. 1 to 9, the same references are used to designate the same elements.

DETAILED DESCRIPTION OF THE INVENTION

Figure 2A:
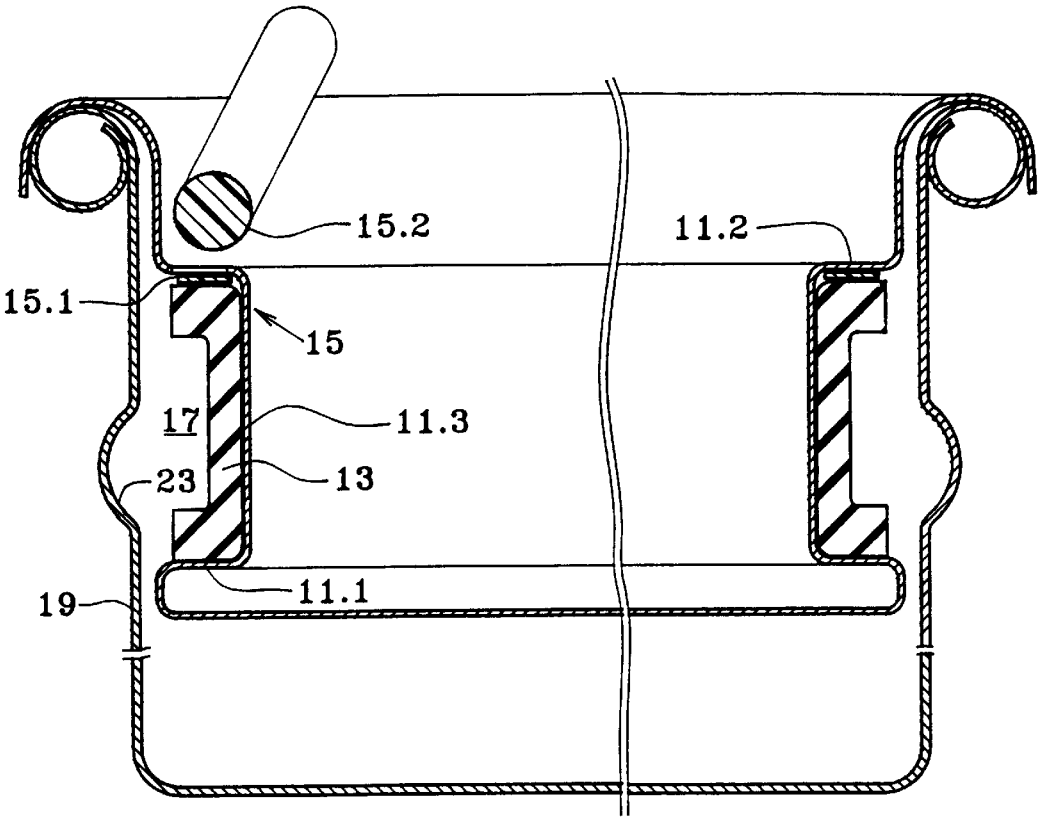

FIGS. 1 to 3*b*, without having any limitative character, show a cylindrical can 1 capable of receiving paint, provided with a handle 3 and closed by a cover 5 comprising a plane wall 7 closing the opening 9 of the can, integral over its perimeter with a peripheral chamber 11 for receiving a seal 13 and means 15 for compressing the seal 13 in a direction perpendicular to the plane of the wall 7. In the examples shown, the means 15 for compressing the seal 13 comprises a washer 15.1 which is flat (FIGS. 2*a*, 2*b*) or has an L-shaped cross-section (FIGS. 3*a*, 3*b*) and a rod 15.2, cylindrical for example.

The peripheral chamber 11 comprises on its perimeter an opening 17 for the passage of the seal 13 compressed towards a wall 19 of the can 1 delimiting the opening 9. In the examples shown, the peripheral chamber 11 has a rectangular cross-section with rounded corners, comprising a bottom wall 11.1 and a top wall 11.2 parallel to the wall 7 of the cover 5, connected by a cylindrical wall 11.3 whose axis is normal to the wall 7. The junctions between the walls 11.1 and 11.2, on the one hand, and the wall 11.3, on the other, advantageously have a radius of curvature which, in the embodiment shown in FIGS. 3*a*, 3*b*, corresponds to the radius of curvature of the L-section washer 15.1, and of one end 21 of the seal 13. Advantageously, the wall 19 of the can 1 presents facing the opening 17 of the peripheral chamber 11, a cavity 23 against which the seal 13 pushes when it is in the compressed condition. In the example shown in FIGS. 2*a*, 2*b*, 3*a*, and 3*b*, the cavity 23 is a shallow U-section groove extending on the perimeter of the cylindrical wall 19. In a variant, as shown in FIG. 6, the seal 13 bears on a cylindrical surface 23' of the wall 19 of the can 1 surmounted by a shoulder for retaining the seal. It is quite obvious that the wall 19 of the can 1 may, without leaving the scope of the present invention, be provided with other retaining means of the seal 13 in the compressed condition. Similarly, a reservoir devoid of cavities 23 is not beyond the scope of the present invention.

The dimensions of the peripheral chamber 11 are selected so that they can accommodate the seal 13 in the uncompressed condition (can open), and the seal as well as the compressing means 15 in the compressed condition (can closed).

The compressing means 15 of the seal 13 advantageously comprises a rod 15.2 introduced into the peripheral chamber 11 through an opening 25 extending along a short length of the wall 11.2. The rod 15.2 has good axial rigidity while being flexible perpendicularly to its axis to be able to match the curvature of the peripheral chamber 11. Advantageously, the end of the rod 15.2 is provided with gripping means 27, for example a handle. For example, during the industrial packaging of paint in the can 1, the rod 15.2 and/or the opening 25 can be provided with a tamperproof device which guarantees to a potential buyer that the can has not been opened or partially used. For example, a cap can be attached, on the one hand, to the perimeter of the opening 25 and, on the other, to the end of the rod 15.2, projecting through the opening 25. The can 1 can only be opened by removing the rod 15.2 from the chamber 11 and consequently by tearing off the cap forming the tamperproof device. The rod 15.2 can bear on the seal 13 directly or by means of an intermediate element, for example a rigid washer 15.1. The rigid washer 15.1 and/or the rod 15.2 advantageously have a low friction coefficient. In a variant, the washer 15.1 can be incorporated with the seal 13 and/or with the rod 15.2.

Figure 2B:
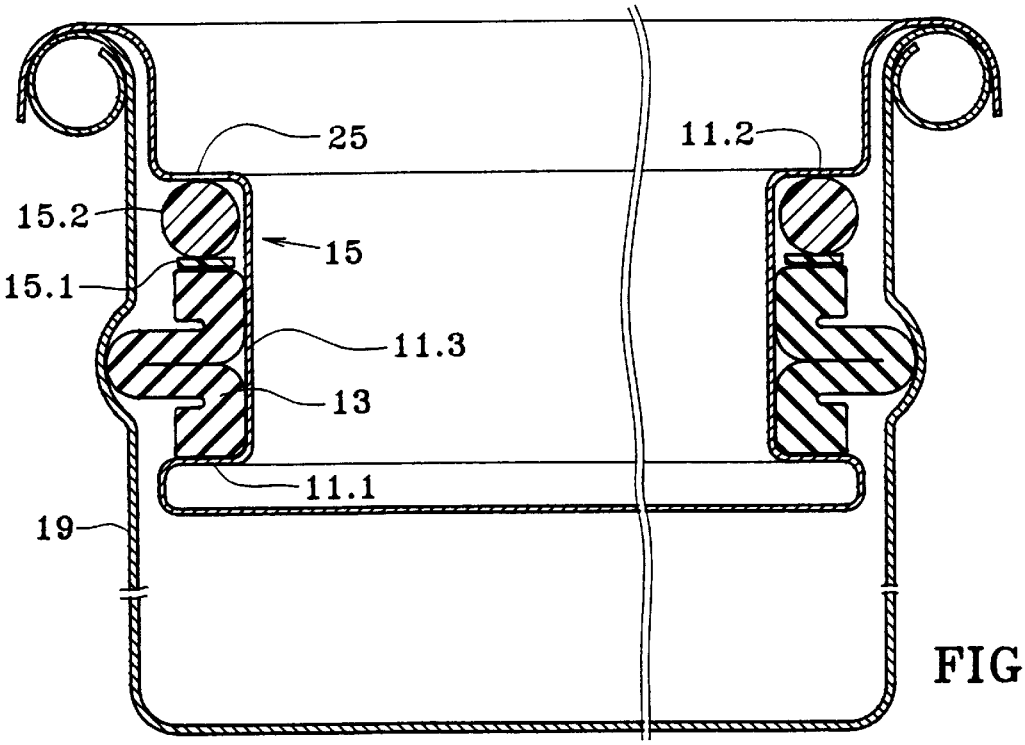

FIGS. 2*a*, 2*b* show a seal 13 having a ] (bracket) cross-section whose concavity is pointed towards the wall 19 of the can 1. The insertion of the rod 15.2 ensures the compression of the seal 13, the central portion 29 pressing into the cavity 23 of the wall 19 of the can 1, and the ends of the seal pressing against the walls 11.1 and 11.3 of the chamber 11. The compressed seal 13 ensures the mechanical securing of the cover 5 on the can 1, as well as a hermetic seal necessary for the proper preservation of the different products, particularly of paints containing solvents.

Figure 3A:
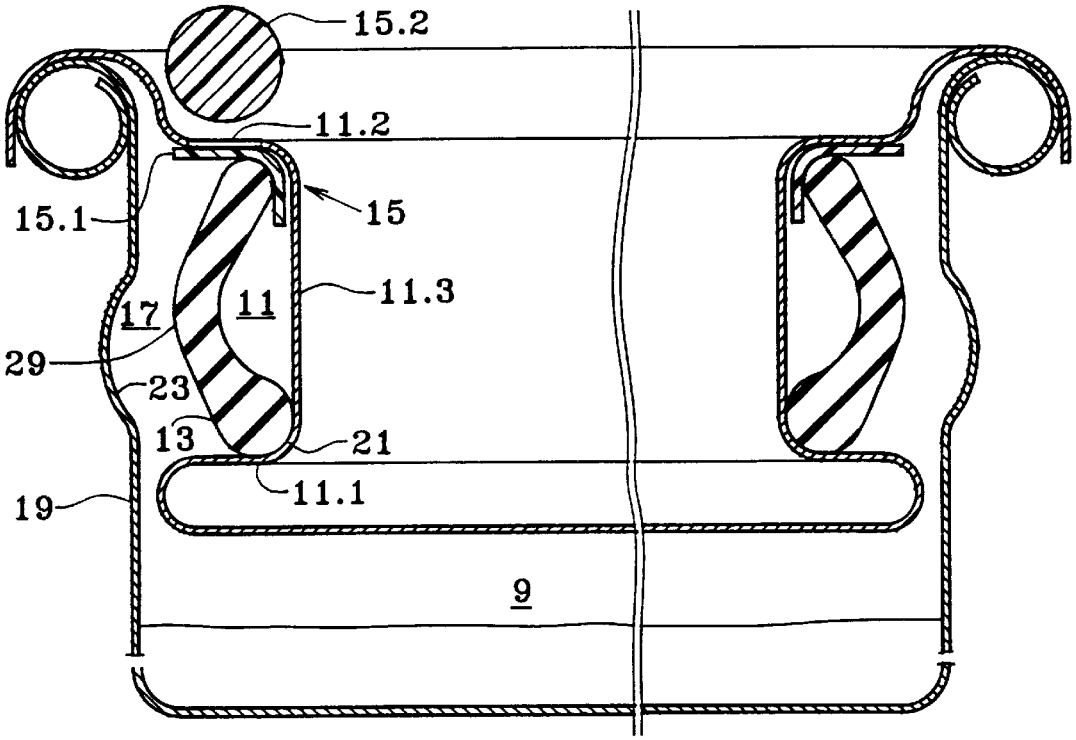
Figure 3B:
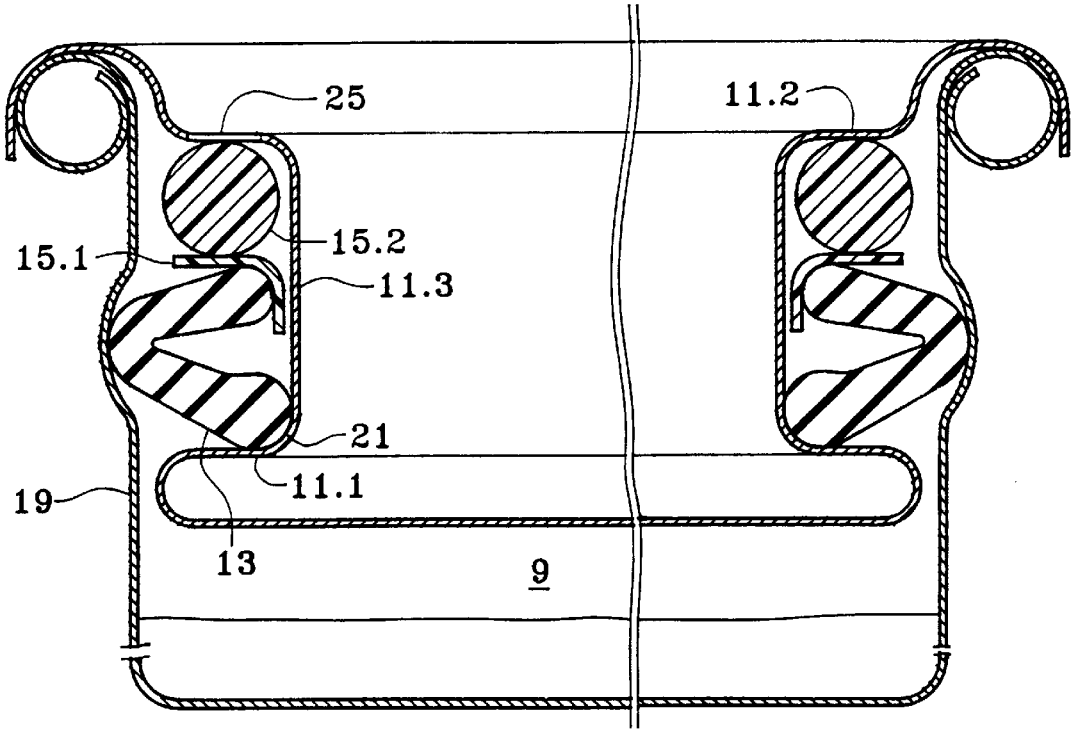

FIGS. 3*a*, 3*b* show a seal 13 with a C-shaped cross-section whose concavity is pointed towards the side of the wall 11.3 of the chamber 11. The insertion of the rod 15.2 into the chamber 11 causes the compression of the seal 13, with rotation of the bottom end 21, an apex 29 of the convexity of the C pressing into the concavity 23 of the wall 19 of the can 1.

FIGS. 4*a*, 4*b*, 5*a*, and 5*b* show two embodiments comprising a seal 13 thrust radially by the rod 15.2 into the cavity 23 of the wall 19 of the can. The rod 15.2, as shown in FIGS. 4 and 5, bears directly on the seal 13, or bears on an intermediate elastic element (not shown), which is substantially cylindrical for example. The intermediate element serves to reduce the friction between the rod 15.2 and the seal 13.

Figure 4A:
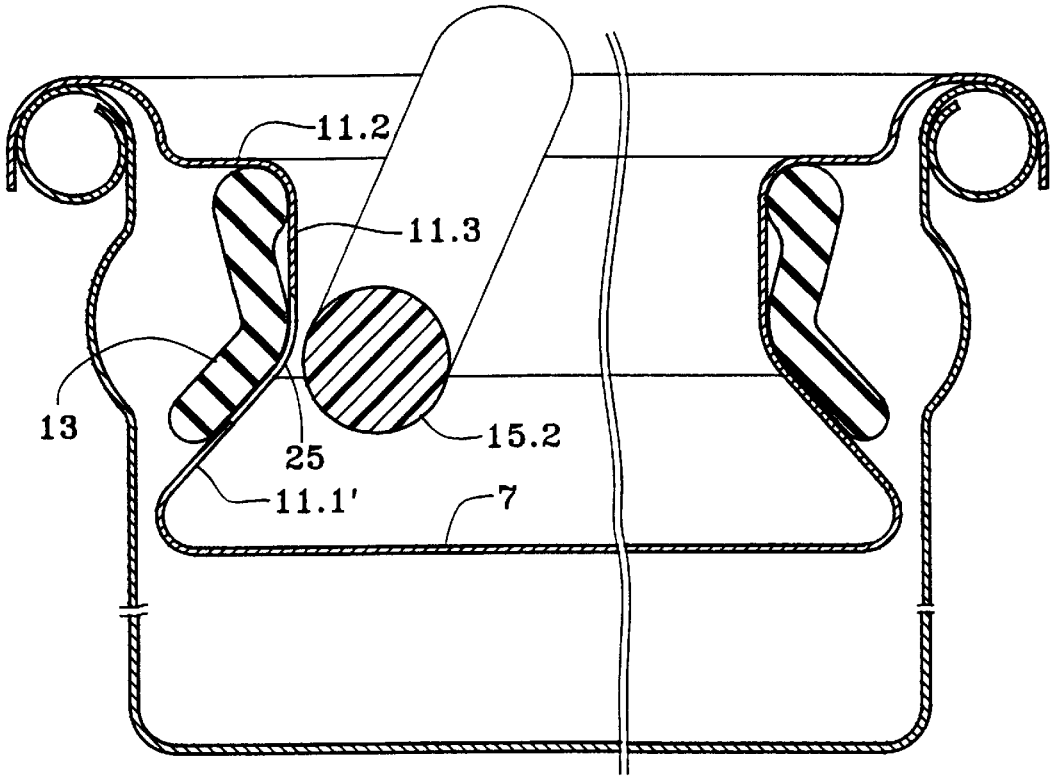
Figure 4B:
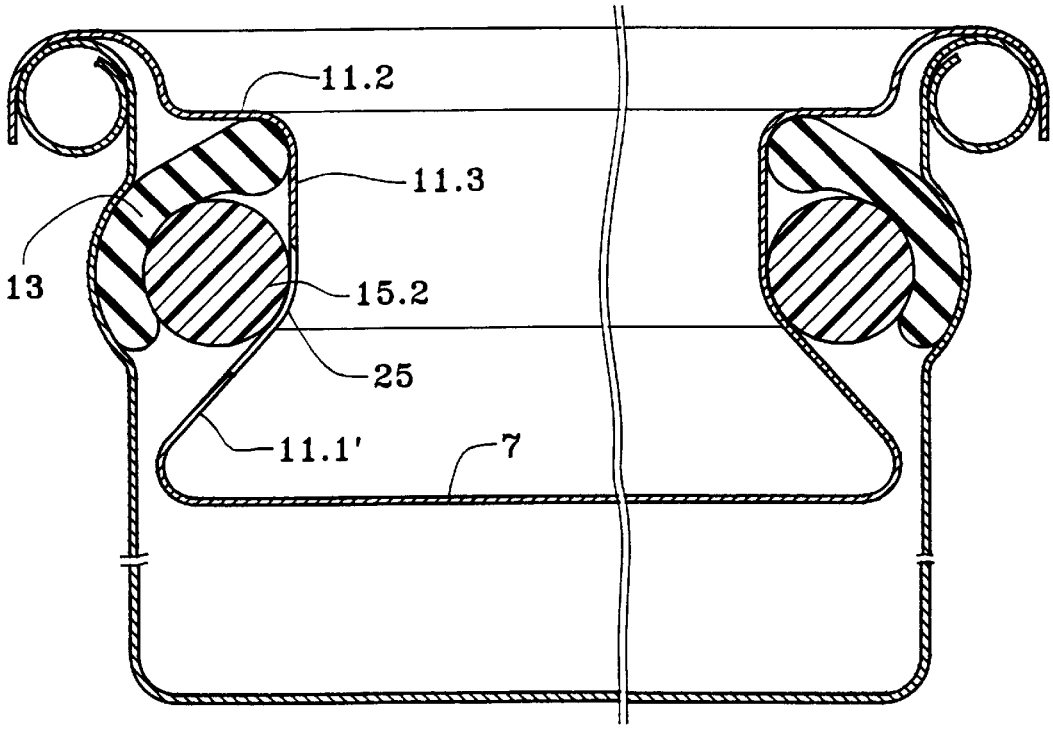
Figure 5A:
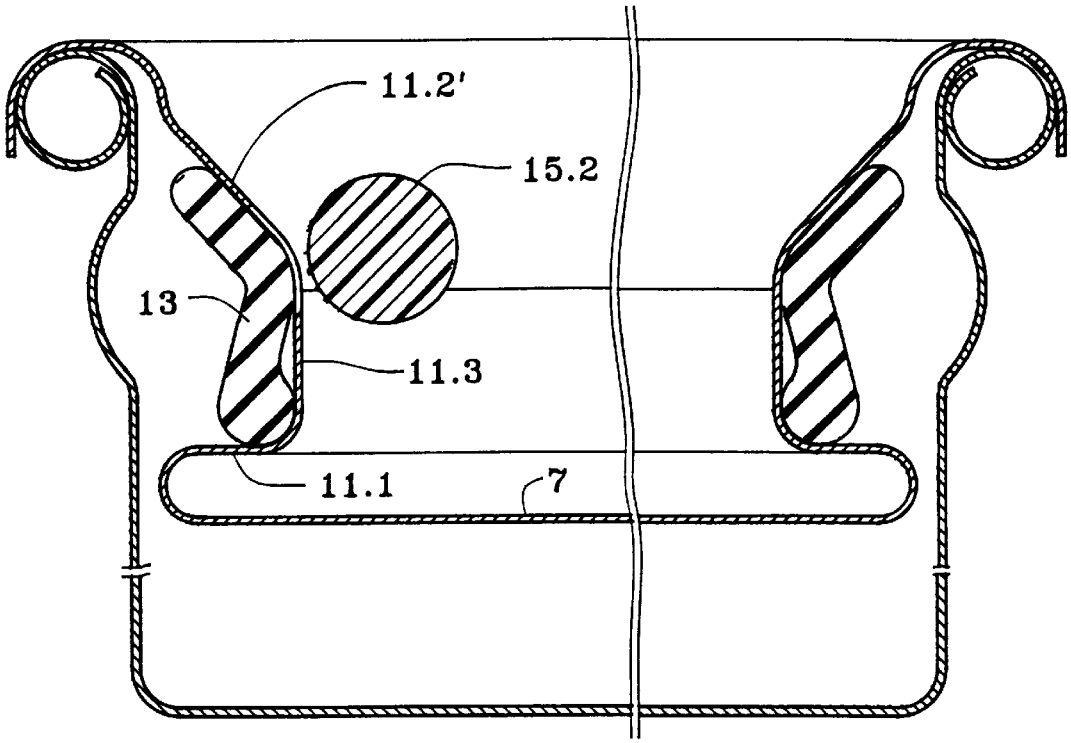
Figure 5B:
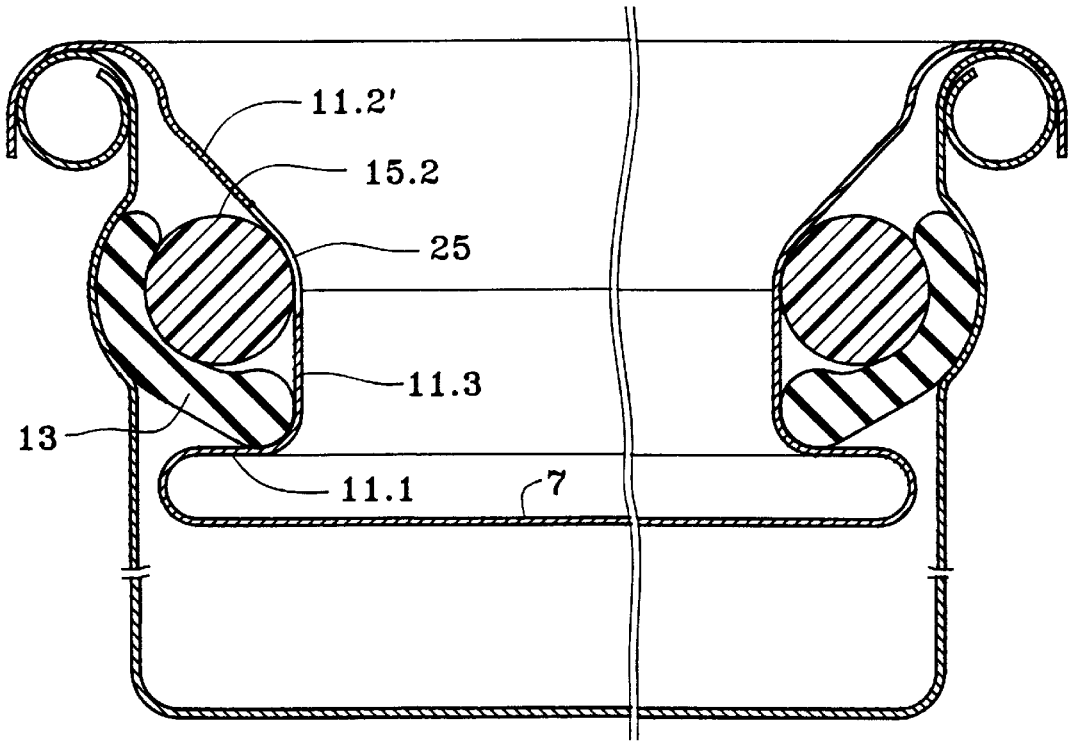

In the non-limitative example shown in FIGS. 4*a*, 4*b*, 5*a*, and 5*b*, the seal 13 has a , (comma) cross-section when uncompressed. When the can is closed, the rod 15.2 bears against the convex portion of the seal 13 which it distorts and presses the originally concave portion of the seal 13 into the concavity 23 of the wall 19 (FIGS. 4*b* and 5*b*). In the example in FIGS. 5*a*, 5*b* the chamber 11 has a bottom wall 11.1, a cylindrical wall 11.3 and a sloping top wall 11.2'. The opening 25 for inserting the rod 15.2 is located at the junction of the walls 11.3 and 11.2.

The embodiment in FIGS. 4*a*, 4*b* has a chamber 11 comprising a top wall 11.2 parallel to the wall 7, a cylindrical wall 11.3 and a sloping bottom wall 11.1'. The opening 25 for inserting the rod 15.2 is provided at the junction of the walls 11.3 and 11.1'.

FIGS. 7 to 9 show examples of O-rings 13 capable of being used in the device of the invention. The seal in FIG. 7 has a circular cross-section.

FIG. 8 shows a tubular seal 13.

FIG. 9 shows a tubular seal 13 whose central cavity is filled with a foam 13', for example, a closed-cell foam.

It is obvious that the carrying into practice of other shapes of seals, such as I, Ω, L or S shaped seals, is not beyond the scope of the present invention. The seals 13 are advantageously made of an elastomer whose hardness is, for example, 70 Shore A. The seals 13 can be made by molding or by extrusion and welding. They can be provided with a thinner cross-section at the surface located directly opposite the wall 11.3 of the peripheral chamber 11, in order to facilitate the compression. However, such a notch also decreases the return forces ensuring the transition to the uncompressed condition (FIGS. 2*a* and 2*b*) when the rod 15.2 is removed from the peripheral chamber 11. Similarly, the surface of the seal 13 can be provided with teeth for locally increasing the pressure applied to the receiving surface delimiting the opening to be closed.

It is obvious that the carrying into practice of other types of rods, for example, rods having an I, trapezoidal, square or rectangular cross-section, is not beyond the scope of the present invention.

Similarly, it is possible to use a plurality of rods, for example, two rods whose total length is substantially equal to the perimeter of the peripheral chamber 11.

The can 1 and the cover 5 are advantageously made of sheet metal. It is obvious that the carrying into practice of seals of other materials, particularly of plastomer or of a mixture of elastomer and plastomer, is not beyond the scope of the present invention.

We shall now explain the functioning of the can 1 of the present invention. The can 1 is filled for example with paint. The peripheral chamber 11 of the cover 5 is lined with a seal 13 advantageously supplemented by a washer 15.1. The cover 5 is disposed on the can 1. The rod 15.2 is introduced into the peripheral chamber 11 of the cover 5 through the opening 25 and in the direction of the arrow 31. The rod 15.2 has substantially the same length as the peripheral chamber 11. The flexibility of the rod 15.2 guided by the chamber 11 serves to crush the seal 13 along substantially its whole length. One end of the rod 15.2 projects from the opening 25 to permit the opening of the can 1. Advantageously, a tamperproof cap is placed around the rod 15 and the perimeter of the opening 25 (not shown). It should be observed that the introduction of the rod 15.2 into the peripheral chamber 11 is an operation that can be easily automated.

The user wishing to open the can 1 pulls on the visible end of the rod 15.2, for example on the handle 27, in the direction of the arrow 33. Due to the elasticity of the rod 15.2, after it is removed from the peripheral chamber 11, the seal 13 resumes the uncompressed shape shown in FIGS. 2*a*, 3*a*, 4*a* and 5*a*, allowing an effortless removal of the cover 5. After use, the can 1 can be re-closed repeatedly by applying the cover 5, and by a renewed, manual introduction of the rod 15.2 in the direction of the arrow 31.

It is obvious that the present invention is not limited to the use of rods 15.2 and includes any means of compressing the seal along substantially its whole length.

Similarly, the present invention is not limited to the cylindrical can but applies to any reservoir permitting the carrying into practice of the means 15 for compressing the seal.

I claim:

1. The combination of a reservoir having a peripheral wall defining a reservoir opening and a cover for sealing said reservoir opening, said cover comprising:

a planar first wall substantially spanning the opening and having a periphery;

a sidewall coupled to and extending from said periphery of said first wall in a direction substantially perpendicular to the plane of said first wall, said sidewall having formed therein a peripheral chamber and having a rod opening therethrough communicating with said peripheral chamber, said peripheral chamber having a peripheral opening that opens outwardly of said periphery of said first wall;

a flexible seal disposed in said peripheral chamber; and a flexible rod for insertion through said rod opening into said peripheral chamber to engage a portion of said sidewall in said peripheral chamber and to urge a portion of said seal out of said peripheral opening along substantially the entire periphery of said seal a sufficient distance to sealingly engage said peripheral wall when said cover is inserted into said reservoir opening;

said peripheral wall having a concavity on the periphery of the reservoir opening, said portion of said seal extending from said peripheral opening engaging said concavity in said peripheral wall when said cover is inserted into said opening and said rod is inserted through said rod opening.

2. The combination of claim 1, further comprising a washer disposed in the peripheral chamber between the seal and the rod.

3. The combination of claim 1, wherein the peripheral chamber has a rectangular cross-section.

4. The combination of claim 1, wherein the first wall and the sidewall are integrally formed of sheet metal.

5. The combination of claim 1, wherein the seal has a C-shaped form, with a convexity pointed towards the peripheral opening.

6. The combination of claim 1, wherein the concavity is a groove forming the edge of the opening to be closed.

7. The combination of claim 1, wherein the reservoir is a paint can of cylindrical shape.

8. The reservoir of claim 1 wherein the compressed seal ensures the mechanical securing of the cover on the reservoir.

9. The combination of claim 1 wherein said seal is configured to be compressed by said rod in a direction perpendicular to the plane of said first wall.

10. The combination of claim 1 wherein said seal is configured to be compressed by said rod in a direction parallel to the plane of said first wall.

11. The combination of claim 1, wherein the rod has a circular cross-section and a length substantially equal to the peripheral length of the seal.

12. The combination of claim 11 wherein said rod material is plastic.

13. The combination of claim 1 wherein the flexible rod is for linear insertion through said rod opening into said peripheral chamber.

14. The combination of claim 13, further comprising a washer disposed in the peripheral chamber between the seal and the rod.

15. The combination of claim 13, wherein the peripheral chamber has a rectangular cross-section.

16. The combination of claim 13, wherein the seal has a C-shaped form, with a convexity pointed towards the peripheral opening.

17. The combination of claim 13, wherein the rod has a circular cross-section and a length substantially equal to the peripheral length of the seal.

18. The combination of claim 13, wherein the seal is configured to be compressed by the rod in a direction perpendicular to the plane of the first wall.

19. The combination of claim 13, wherein the seal is configured to be compressed by the rod in a direction parallel to the plane of the first wall.

* * * * *